US008235820B2

(12) United States Patent
Fine

(10) Patent No.: US 8,235,820 B2
(45) Date of Patent: Aug. 7, 2012

(54) GAMING DEVICE SYSTEM ALLOWING PHOTOS TO BE DOWNLOADED AS GAME INDICIA ON GAMING DEVICE AND METHOD OF USE

(76) Inventor: Jonathan Fine, Henderson, NV (US)

( * ) Notice: Subject to any disclaimer, the term of this patent is extended or adjusted under 35 U.S.C. 154(b) by 0 days.

(21) Appl. No.: 13/157,765

(22) Filed: Jun. 10, 2011

(65) Prior Publication Data

US 2011/0237321 A1 Sep. 29, 2011

Related U.S. Application Data

(63) Continuation of application No. 12/840,822, filed on Jul. 21, 2010, which is a continuation-in-part of application No. 11/963,602, filed on Dec. 21, 2007.

(51) Int. Cl.
*A63F 9/24* (2006.01)

(52) U.S. Cl. ..... 463/42

(58) Field of Classification Search ..... 463/16–20, 463/40–43, 25, 29
See application file for complete search history.

(56) References Cited

U.S. PATENT DOCUMENTS

| | | | | |
|---|---|---|---|---|
| 5,465,982 | A | 11/1995 | Rebane | |
| 5,941,774 | A | 8/1999 | Takemoto et al. | |
| 6,234,900 | B1 | 5/2001 | Cumbers | |
| 6,942,575 | B2 | 9/2005 | Mergler | |
| 7,785,204 | B2 | 8/2010 | Wells et al. | |
| 7,883,418 | B2 | 2/2011 | Hiroyama et al. | |
| 7,951,006 | B2 | 5/2011 | Wells et al. | |
| 2002/0151366 | A1 * | 10/2002 | Walker et al. | 463/42 |
| 2003/0083132 | A1 | 5/2003 | Berg et al. | |
| 2003/0162594 | A1 | 8/2003 | Rowe | |
| 2004/0204229 | A1 * | 10/2004 | Walker et al. | 463/20 |
| 2005/0020358 | A1 | 1/2005 | Cram | |
| 2005/0064926 | A1 | 3/2005 | Walker et al. | |
| 2005/0096124 | A1 * | 5/2005 | Stronach | 463/25 |
| 2006/0019746 | A1 | 1/2006 | Seelig et al. | |
| 2006/0119707 | A1 | 6/2006 | Merrell et al. | |
| 2006/0158522 | A1 | 7/2006 | Pryor | |
| 2006/0177109 | A1 | 8/2006 | Storch | |
| 2006/0178188 | A1 | 8/2006 | LeMay et al. | |
| 2006/0223628 | A1 | 10/2006 | Walker et al. | |
| 2010/0062840 | A1 | 3/2010 | Herrmann | |
| 2010/0317442 | A1 | 12/2010 | Thomas et al. | |
| 2011/0014975 | A1 | 1/2011 | Grabiec et al. | |

FOREIGN PATENT DOCUMENTS

WO WO 2006/022774 3/2006

* cited by examiner

*Primary Examiner* — Omkar Deodhar
(74) *Attorney, Agent, or Firm* — Greenburg Traurig

(57) ABSTRACT

A system and method for allowing users to select photos from social networking websites (e.g., Facebook®) or other dedicated websites for use with select gaming devices wherein the selected photos are used as game indicia (e.g., game reel indicia). Thus, instead of cherries and bars, the gaming device may depict photos of a player's girlfriend and pet. "Friends" of the player may also be able to observe the real-time gaming activities of the player via the social networking website or other dedicated website.

9 Claims, 5 Drawing Sheets

GAMING DEVICE SYSTEM ALLOWING PHOTOS TO BE DOWNLOADED AS GAME INDICIA ON GAMING DEVICE AND METHOD OF USE

CROSS-REFERENCE TO RELATED APPLICATIONS

This application is a continuation of U.S. patent application Ser. No. 12/840,822 filed on Jul. 21, 2010, which is a continuation-in-part of U.S. patent application Ser. No. 11/963,602 filed on Dec. 21, 2007, which is incorporated herein in its entirety.

FIELD OF THE INVENTION

The embodiments of the present invention relate to an electronic gaming device (e.g., slot machine). In one embodiment, a player is able to select photos from a dedicated website to use as game reel indicia.

BACKGROUND

Electronic gaming devices, like slot machines, now account for over 60% of gaming revenue in casinos. Accordingly, new slot machine concepts are in increasing demand to satisfy the gaming public. Recent successful slot machine advances include large progressive jackpots, high resolution video graphics and bonus games.

In particular, bonus games are now associated with a majority of the slot machines in the marketplace. For example, the Wheel of Fortune slot machine includes a bonus game in the form of a numbered mechanical wheel. The bonus game, namely the wheel, is activated in response to pre-established primary game outcomes. Other bonus games comprise video-implemented games, ball-hoppers and player-selected outcomes.

Even though there has been an influx of new slot machines and bonus games, the new concepts and features are of a common theme and do not add to the overall excitement level of slot machine play.

Thus, there is a need for a new and exciting slot machine concept. Advantageously, the new concept should include player participation to enhance the game playing experience.

SUMMARY

Accordingly, a first embodiment of the present invention comprises a method of conducting an electronically-implemented wagering game comprising: utilizing an electronic gaming device to facilitate a game of chance; capturing an image of a player of the electronic gaming device via an image capturing device integrated into, onto or adjacent to the electronic gaming device; and placing the captured image into a video-based portion of the game of chance and optionally any electronic gaming device affiliated therewith.

A system embodiment of the present invention comprises: one or more affiliated electronic gaming devices for facilitating games of chance, said one or more electronic gaming devices having at least a processor, random number generator, memory, display, one or more user interfaces and an image capturing device, said image capturing device positioned to capture an image of a player playing the one or more electronic gaming devices; means for transmitting the captured image of the player to all affiliated electronic gaming devices; and means for incorporating the captured image into the games of chance facilitated by said affiliated electronic gaming devices.

In another embodiment, photos from social networking websites (e.g., Facebook®) or other dedicated websites are downloadable to select gaming devices to be used as game reel indicia. Thus, instead of cherries and bars, the gaming device may depict photos of the player's girlfriend and pet. In one embodiment, "friends" of the player are able to observe the real-time gaming activities of the player via the social networking website or other dedicated website.

Other variations, embodiments and features of the present invention will become evident from the following detailed description, drawings and claims.

DETAILED DESCRIPTION

Figure 1:
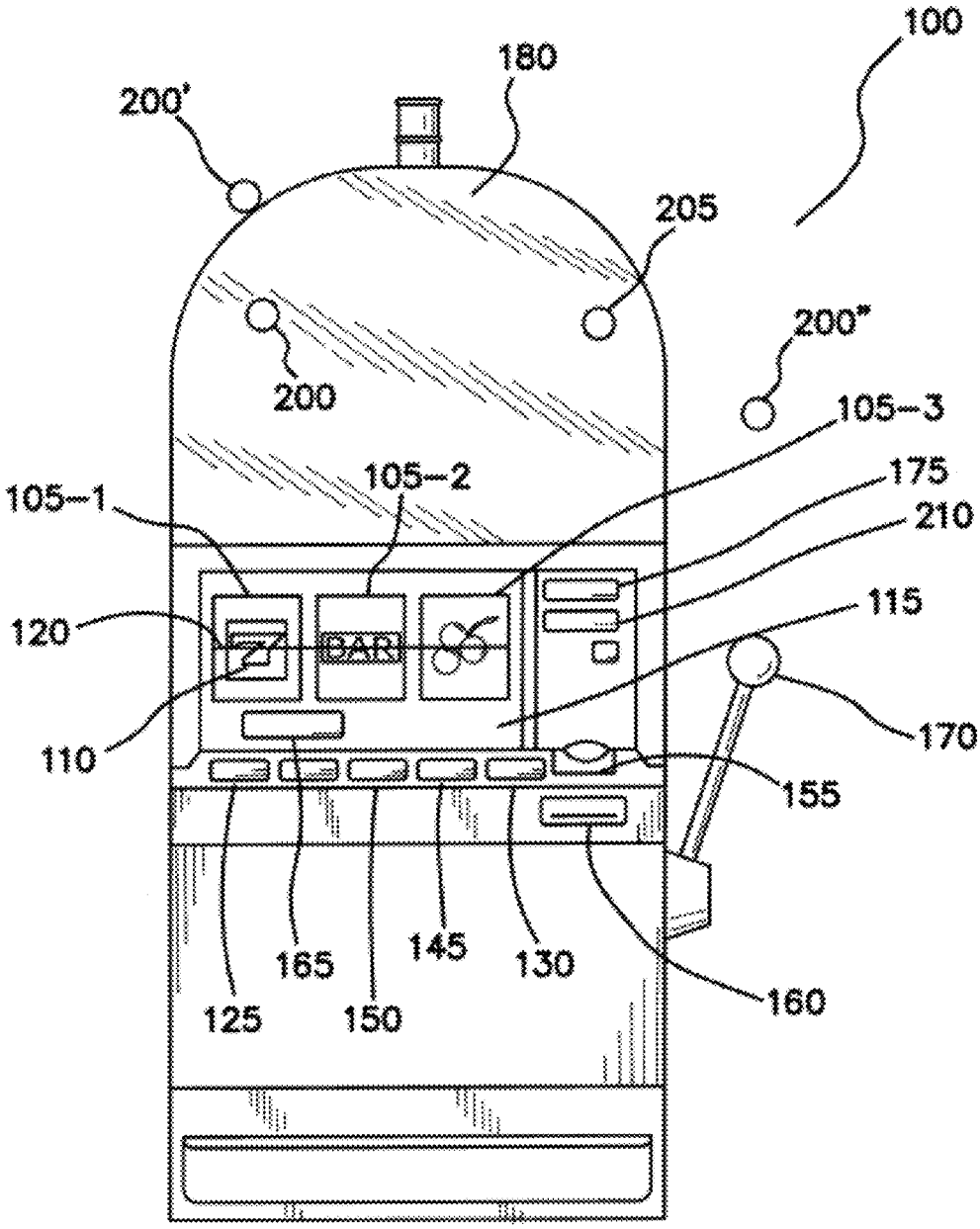
FIG. 1 shows a slot machine according to a first embodiment of the present invention.

The operation of slot machines is controlled by microprocessors which communicate with internal memory devices and the external features of the machines. The microprocessors also incorporate, or communicate with, a random number generator which ensures the randomness of the machines' outcomes. In the embodiments of the present invention, one or more processors, along with memory and related devices, control the new applications disclosed herein. Therefore, the embodiments, along with the corresponding odds, of the present invention may be programmed into the processor or associated software. Since the technology for operating and controlling slot machines is well known to those skilled in the art, the subtle details are not described herein.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Although a slot machine is used to describe the embodiments of the present invention, it is conceivable that the embodiments may be utilized with other gaming devices including video poker machines, keno machines and bingo machines.

Reference is now made to the figures wherein like parts are referred to by like numerals throughout. FIG. 1 illustrates a slot machine for facilitating the embodiments of the present invention generally referred to by reference numeral 100. As shown the slot machine 100 includes three video game reels 105-1 through 105-3, depicting game indicia 110 on a machine display 115. The reels may also be mechanical with video portions integrated therein. One or more pay lines 120 are used to determine winning outcomes. While three game reels 105-1 through 105-3 are shown, the number may be more or less. The slot machine 100 further includes player interface buttons, including a one coin/unit wager button 125, maximum coins/units button 130, spin button 145 and cash out button 150. Each of the buttons may be touch screen icons on the video display 115 as well. The machine 100 also includes a coin input 155, card reader 160, credit display 165, slot arm 170 and currency and coupon reader 175.

Optionally, the slot machine 100 further includes a topper 180 for facilitating a bonus game. The bonus game may be facilitated by video means solely or in combination with backlit graphics.

As shown, an image capturing device 200 can be integrated into the topper 180, or an image capturing device 200' may be secured to the topper 180 or elsewhere on the slot machine 100 or an image capturing device 200" may be secured adjacent to the slot machine 100 and linked thereto by means of a wired or wireless connection. It will be recognized by those skilled in the art that the image capturing device may be positioned anywhere in, on or adjacent to the slot machine 100. Ideally, the image capturing device 200 is a digital camera or video camera, but any type of suitable image capturing device may be used. The image capturing device 200 is positioned to capture a photo or video clip of the player's face. In one embodiment, the imaging capturing device 200 is triggered by a motion sensor 205 aimed at head-level of the chair corresponding to the slot machine 100. The sensor 205 should have limited range to prevent it from activating when patrons walk past the slot machine 100. Like the image capturing device, the sensor 205 may be integrated into the topper 180, attached to the topper 180 or positioned adjacent to the slot machine 100. In another embodiment, the image capturing device 200 is triggered in response to currency, coupons or a player card being inserted into the slot machine 100. Ideally, the player authorizes the player's facial image being used via a display device and keypad 210 on the slot machine 100. Accordingly, in one embodiment, once the player inserts currency, coupons or a player card, the display device 210 shows a message requesting that the player approve the use of his or her facial image by, for example, pressing "1" for approve and "2" for decline. Most new slot machines have the display device and keypad 210 positioned above the reels 105-1 through 105-3. The same procedure may be used by means of touch screen technology associated with the slot machine display 115 such that the player simply presses a "Yes" or "No" icon as prompted on the machine display 115.

Once an image is captured, image software analyzes the image to determine if it is acceptable. The image software determines whether the content (e.g., face of the player) and the clarity of the image are suitable for the embodiments of the present invention as described in more detail below. If the software determines that the captured image is not acceptable, the image capturing device 200 is activated a second time to capture a new image. Besides clarity and assuring a facial image, the software may also reject as unacceptable any captured images involving vulgar gestures or activities by a player. The image capturing process may be repeated any number of times as determined by a casino. Once an acceptable image is captured, it is temporarily or permanently stored in a memory or storage device. The memory device may be random access memory (RAM), flash memory, hard drive memory or any suitable type of storage or memory. The memory device may be integrated into the slot machine or may be associated with a bank of machines or a central storage device associated with all machines in a casino or multiple casinos. Depending on the casino and/or the player, the image may be stored temporarily until it is integrated into a casino game or may be stored in a player database for use during subsequent game sessions by the player.

If the image is stored for use during a subsequent gaming session, the player may be prompted to accept use of the image at the subsequent gaming session or may be prompted to allow a new image to be captured. Again, this may be accomplished using a small display device or touch screen technology.

Figure 2:
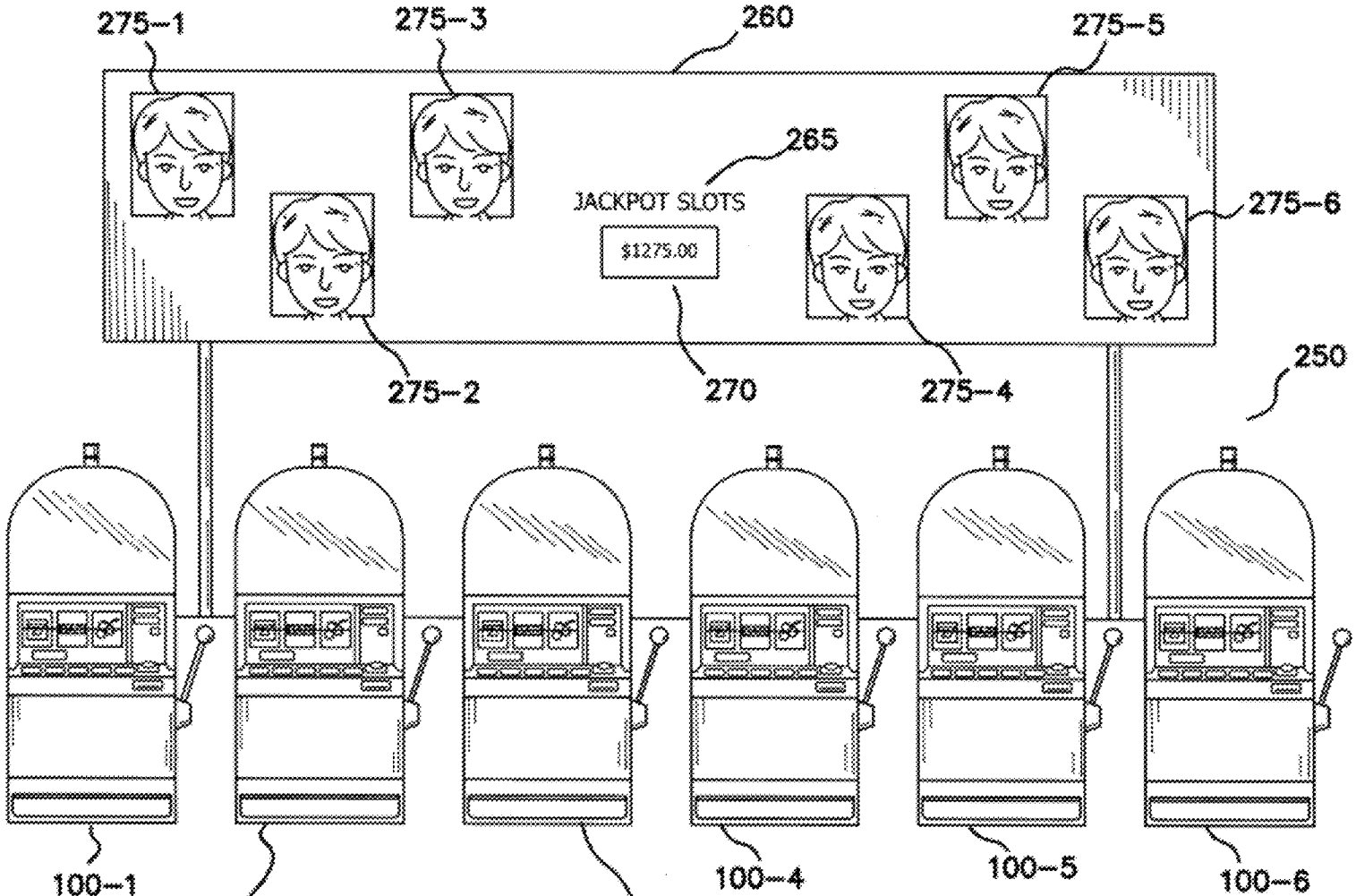
FIG. 2 shows a bank of slot machines and a corresponding bank display device which utilizes the embodiments of the present invention.

Now referring to FIG. 2, a bank 250 of slot machines 100-1 through 100-6 is shown. The bank 250 includes a bank display 260 for displaying a game name 265 associated with the slot machines 100-1 through 100-6, jackpot information, including a progressive jackpot amount 270, if any, and any other information deemed appropriate. With the embodiments of the present invention, the bank display 260 may also include player locations 275-1 through 275-6 for displaying player images 280-1 through 280-6 as captured by the image capturing devices 200-1 through 200-6 positioned within, on or adjacent to the slot machines 100-1 through 100-6 forming the bank 250. The player locations 275-1 through 275-6 provide a mechanism for players, and others, to observe the images displayed prominently in the casino. In one embodiment, the images randomly change locations after a brief pre-established period of time (e.g., 30 seconds). If certain of the machines 100-1 through 100-6 are unoccupied, the corresponding player locations 275-1 through 275-6 may be left blank or may display a message like "Your Face Here" to attract additional players to the bank 250.

Figure 3:
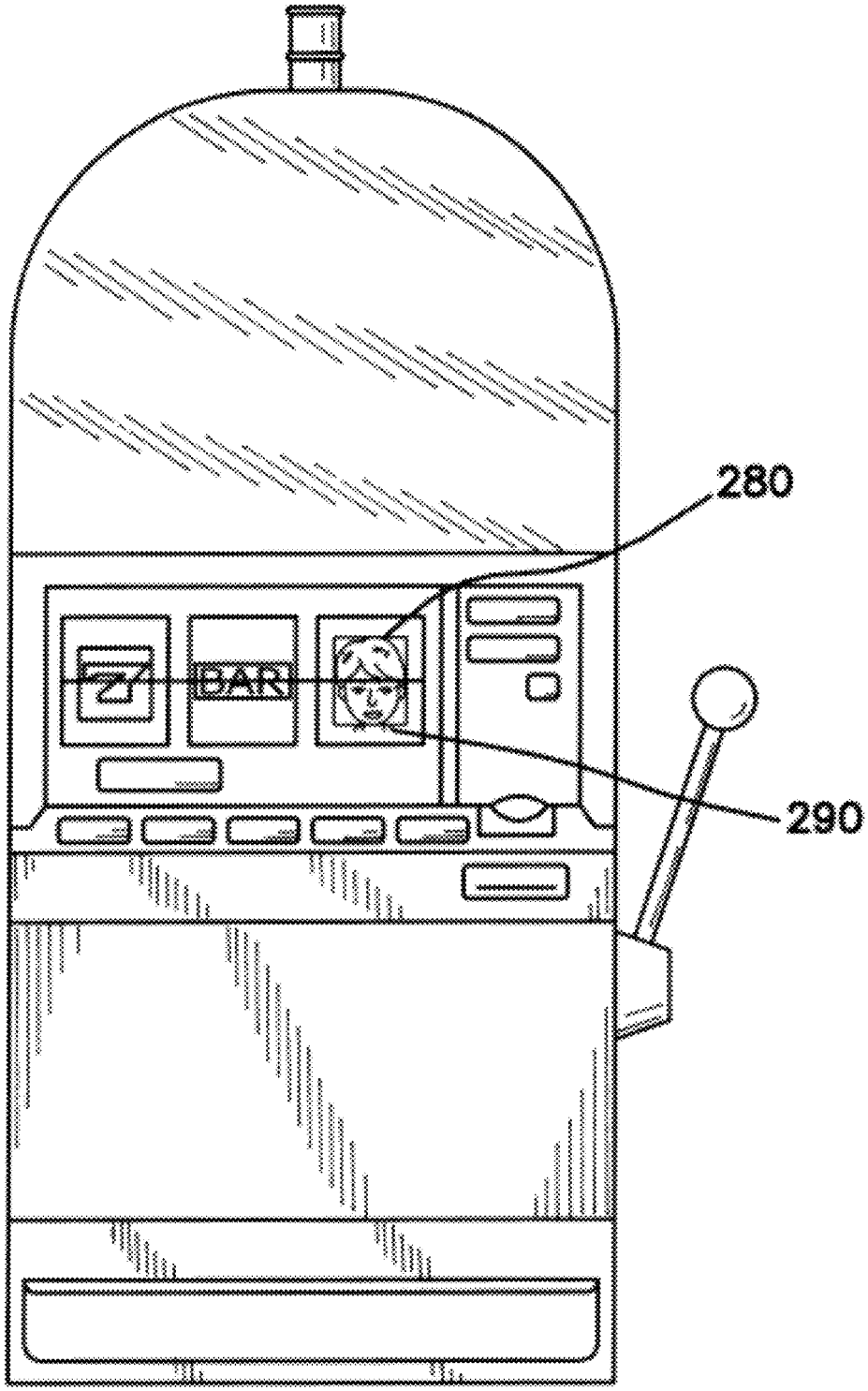
FIG. 3 shows a captured image integrated into a video slot machine primary game.

Besides utilizing player images 280-1 through 280-6 on the bank display 260, captured images 280-1 through 280-1 are utilized in the games being facilitated by the machines 100-1 through 100-6. In one example, as shown in FIG. 3, a captured image 280 is integrated into a primary game as video reel image symbols 290. In practice, a pre-established number of reel symbol positions on each video reel 295-1 through 295-3 are designated as video reel image symbols. That is, the position on the video reels being occupied by the video reel image symbols 290 is programmed into the game such that the designated video reel image symbols 290 are factored into the game pay table. Ideally, the designated video reel image symbols 290 should correspond to various winning outcomes to enhance the player experience. For example, three aligned player images may correspond to a first jackpot and three aligned player images of the same player may correspond to a progressive jackpot. Any number of primary games may be developed using the embodiments of the present invention. In one embodiment, faces of stored friends playing on linked machines appear on the user's game reels. Such an embodiment provides a camaraderie among friends playing the same game or system. In another embodiment, faces of players winning jackpots are automatically displayed on linked machines to alert everyone that the jackpot was won and by whom it was won.

Figure 4:
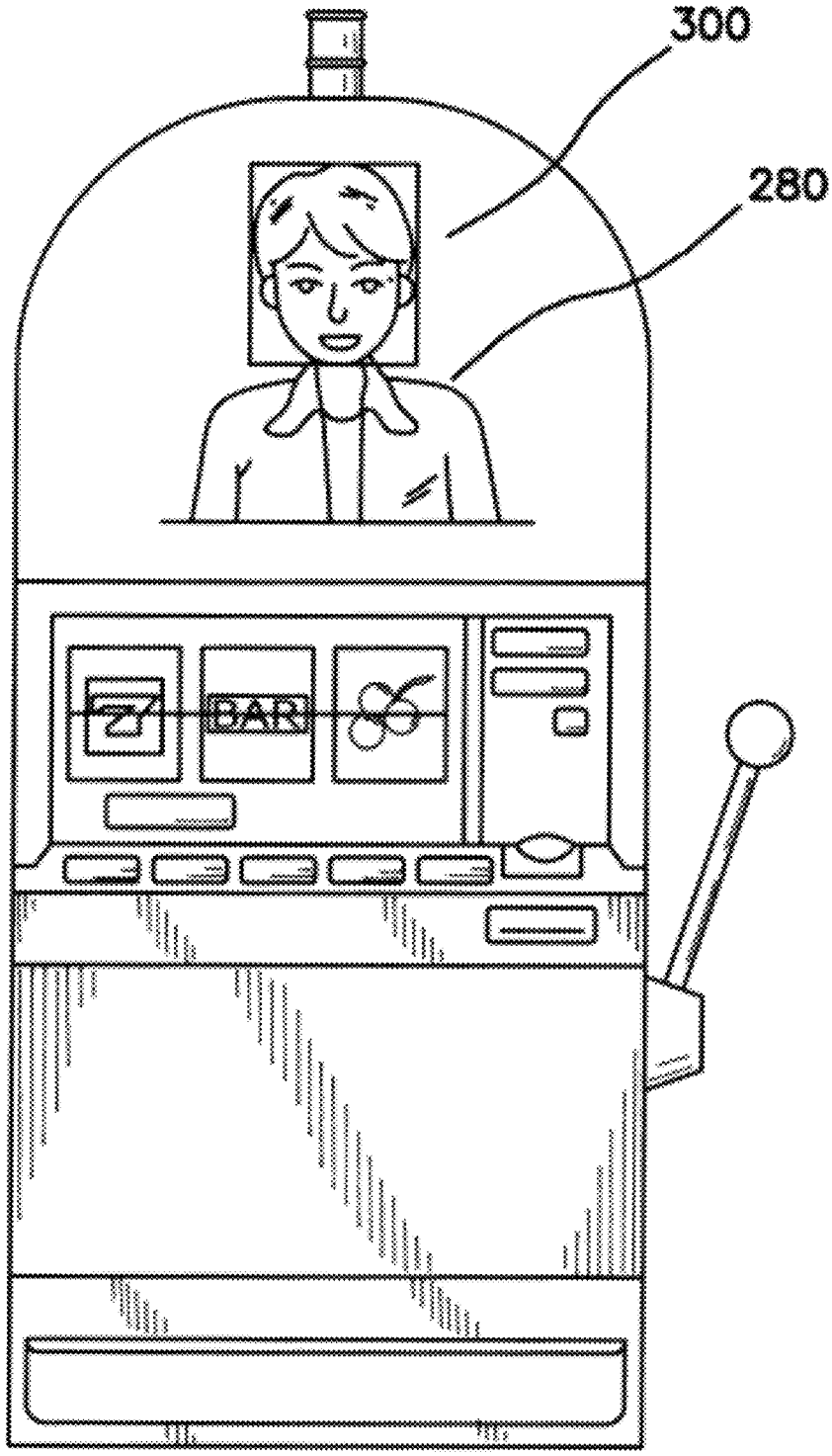
FIG. 4 shows a captured image integrated into a video slot machine bonus game.

As shown in FIG. 4, the captured images 280 may also be used in a bonus game 300 associated with the slot machine 100. Once again, ideally, the captured images 280 should be used to determine winning bonus outcomes to maintain player excitement. For example, a wheel can be divided into a number of sections with certain sections depicting captured images 280-1 through 280-6. The wheel then spins until it stops with a pointer identifying a certain section. If the identified section depicts the player image, a bonus award is provided. Any number of bonus games may be developed using the embodiments of the present invention.

While FIGS. 2-4 show the captured images on either the bank 250, primary game of the slot machine 100 or the bonus game 300 of the slot machine 100, it will be recognized by those skilled in the art that the captured images may also be used on any combination thereof.

An image captured by a first electronic gaming device may be transmitted to a central location (e.g., server) that then transmits the image to affiliated devices in the same bank of devices or multiple banks of devices utilizing the embodiments of the present invention. Alternatively, the image captured at a first electronic gaming device can be transmitted directly to each affiliated electronic gaming device. Affiliated electronic gaming devices can be any electronic gaming devices in the same bank, multiple banks, casino or multiple casinos or any combination thereof desired by the casino. While the description herein focuses on an image capturing device incorporated at or proximate the gaming machine, in other embodiments photos may be downloaded online or uploaded via a link to the central server.

The operation of the image capturing device, image software, transmission of the image and the incorporation of the image into the bank display, primary game and/or bonus game may be controlled by each local slot machine processor and/or the operations may be controlled by a remote processor or controller, such as a central server, or any other computer-based hardware and/or software configuration.

While a slot machine is used above to describe the embodiments of the present invention any electronic gaming machine may benefit from therefrom. For example, in a video poker game, the captured images may be placed on random playing cards such that the use of the random cards in a winning poker hand, results in an enhanced payout. In an alternative example, captured images may be positioned on an electronic keno or bingo card such that those spaces become bonus spaces.

Figure 5:
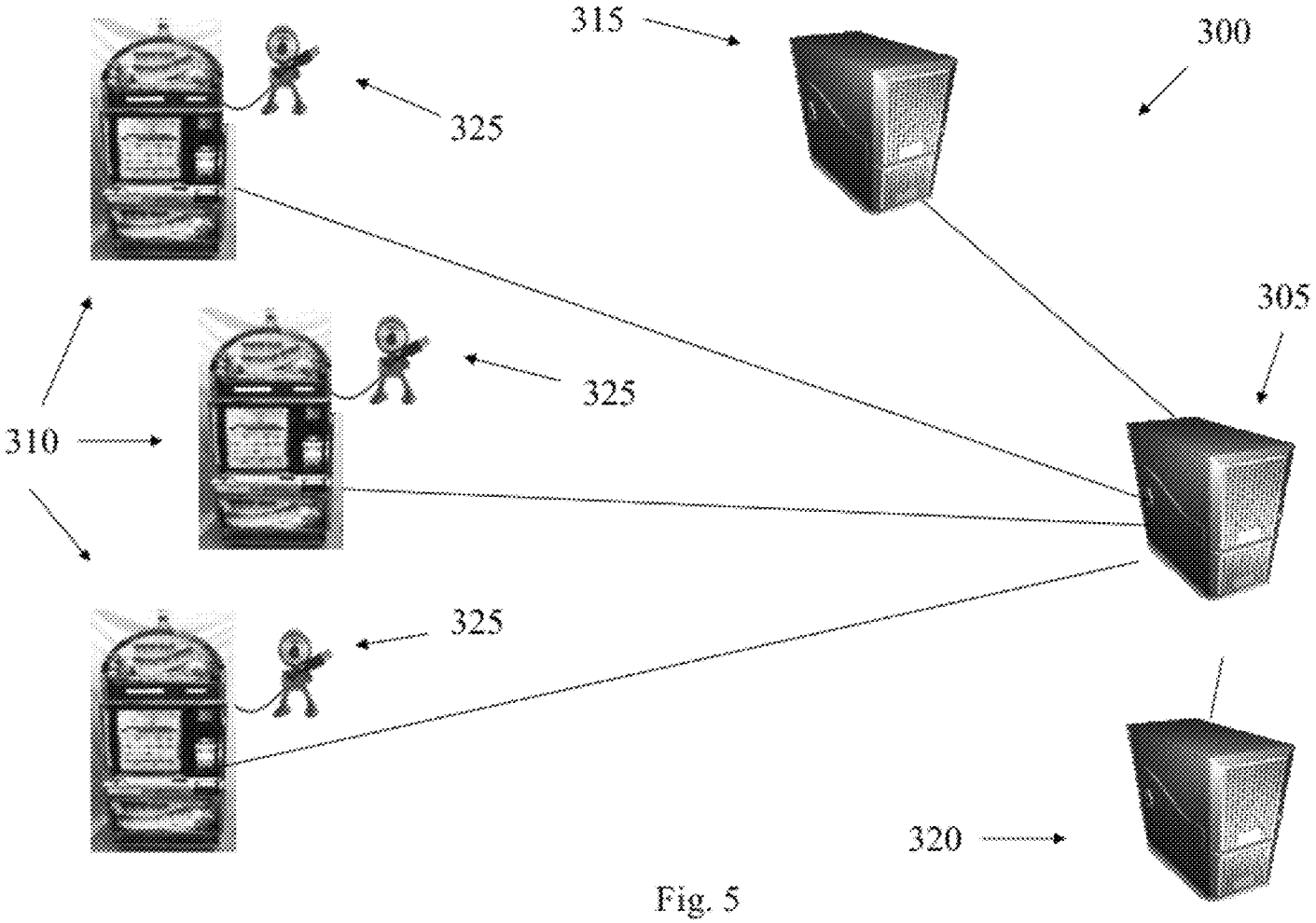
FIG. 5 shows a block diagram of a system for facilitating a social networking embodiment of the present invention.

FIG. 5 shows a block diagram 300 detailing an exemplary social networking embodiment of the present invention. In this embodiment, a casino server 305 manages gaming devices 310 on a casino floor. The casino server 305 may run software directed to player tracking, accounting and related functions. As shown, the casino server 305 communicates with a social networking server 315. The communication between the casino server 305 and social networking server 315 may be via a wired or wireless connection. Given the regulations associated with casino gaming, the connection between the casino server 305 and social networking server 315 is secured via known encryption techniques or other security protocols. Those skilled in the art will recognize that there may be more than one casino server and social networking server. For the sake of brevity, this detailed description assumes there is one of each.

The social networking server 315 maintains/hosts a social networking website, such as Facebook®, in a conventional manner. Users of the website are able to upload photos to the website as part of a user profile. According to the embodiments of the present invention, users of the website are further able to select uploaded photos to be used as gaming indicia on select gaming devices (e.g., slot machines) located in the casino.

To participate in using photos from a social networking server 315 on select gaming devices, users may first be required to register at the casino as part of the casino's player club. Player clubs are ubiquitous and seek to derive loyalty from players in return for comps and other amenities calculated as a function of a player's game play. Registration typically involves the player providing personal information after which the casino provides the player with a player club card. The player club card includes a magnetic stripe with stores player information. Other than player club cards, FOB devices, RFID devices, PIN, biometric devices and the like may be used to identify players at a gaming device. A corresponding player club file is maintained on the casino server 305 for each player club member. Responsive to the player club card being inserted into a gaming device, the player file is identified and updated after the gaming session concludes to accurately reflect the player's game play data (e.g., time played, plays per hour, coins-in, coins-out, etc.).

In one embodiment, once registered as a casino player club member, the player is permitted to select photos from the social networking server 315 causing the selected photos to transmit to the casino server 305 where the selected photos are stored in the player's player club file. The social networking server 305 may be any server configured to store photos uploaded by users having access thereto via a website. The photos may also be stored on separate designated data server 320 in communication with the casino server 305 to avoid using large amounts of casino server storage space. The separate data server 320 is accessible by the casino server 305 via a wired or wireless connection.

In one embodiment, certain video slot machines managed by the casino server 305 are configured to allow the photos stored on casino server 305 or designated data server 320 to be used as reel indicia within the video slot machine. In such an embodiment, responsive to the player inserting his or her player card, the video slot machine prompts the player to select photos from among the photos previously stored by the player. The stored photos are displayed on the video slot machine and selected using a game interface (e.g., buttons, track ball, touch screen, etc.). The photos may be displayed on the primary video slot machine display, bonus display or separate display on the video slot machine. Once selected, the photos are used to replace one or more regular or existing reel indicia on the video slot machine reels. Importantly, the photos do not in any way affect the game outcomes as they are simply used in place of regular reel indicia (i.e., each selected photo is used to replace one regular reel indicia). For example, a first selected photo replaces all cherry reel indicia; a second selected photo replaces all single bar reel indicia; and a third selected photo replaces all double bar reel indicia. Therefore, if regular reel indicia outnumber the selected number of photos, the video slot machine is played with a mix of regular reel indicia and photo reel indicia. Once enough photos to replace all regular reel indicia have been selected, the player is alerted to the same. At this point, the player may confirm the selected photos or replace one or more selected photos with different photos. Besides altering the reel indicia, the selection of the photos causes an alteration of the displayed pay table winning outcomes wherein the replaced reel indicia included in winning outcomes are replaced with the selected photos. For example, wherein the video slot machine may normally depict, in video form, that three cherries aligned along an active pay line results in a 10 unit win, after replacing the cherry reel indicia with a photo of Bob's girlfriend, the video slot machine now depicts three photos of Bob's girlfriend resulting in a 10 unit win. That is, the reference to cherry game indicia is removed from video depiction. Other pay table winning outcomes may be altered to include a combination of regular reel indicia and photo reel indicia. In other words, some winning outcomes include multiple reel indicia such that some winning outcomes may comprise both regular reel indicia and photo reel indicia.

In another embodiment of the present invention, the real-time game play of players on select gaming devices may be observed by "friends" on the social networking website. In one embodiment, a camera 325, such as a web-cam, is positioned facing the display of the video slot machine or other gaming device. The feed of the camera 325 may be accessed by persons accessing the player's profile via the social networking website. In another embodiment, the real-time video slot machine results are directly fed to the social networking website via the casino server 305 which in this embodiment monitors the same.

The social networking embodiments of the present invention may also be used with other games of chance including video poker, keno or bingo games. For example, with video poker games of chance the photos may be used as the backing of the simulated cards.

Although the invention has been described in detail with reference to several embodiments, additional variations and modifications exist within the scope and spirit of the invention as described and defined in the following claims.

I claim:

1. A gaming system comprising:

a first storage device communicatively linked to a plurality of gaming devices configured to conduct games of chance;

a second storage device configured to manage a website through which digital photos may be uploaded to said second storage device; and wherein said first storage device and said second storage device communicate with one another such that said uploaded digital photos on said second storage device are accessible by said first storage device for use on one or more of said plurality of gaming devices in the form of indicia used during play of a subject game thereon.

2. The gaming system of claim 1 wherein said first storage device is a casino server managing said plurality of gaming devices.

3. The gaming system of claim 1 wherein said plurality of gaming devices are video slot machines.

4. A gaming system comprising:

a first server in communication with a plurality of gaming devices configured to conduct games of chance;

a second server configured to store uploaded photos;

wherein said first server and second server are communicatively linked such that photos uploaded to the second server are accessible by said first server; and wherein said plurality of gaming devices are configured to allow players to select photos from said first server for use on one or more of said plurality of gaming devices in the form of game indicia during play of a subject game thereon.

5. The gaming system of claim 4 wherein said first server is a casino server manages said plurality of gaming devices.

6. The gaming system of claim 4 wherein said plurality of gaming devices are video slot machines.

7. A method comprising:

accessing photos from a website server;

moving said photos to a server in communication with a plurality of gaming devices configured to conduct games of chance;

identifying a player at a gaming device selected from said plurality of gaming devices;

responsive to identification of a player at said gaming device selected from said plurality of gaming devices, presenting to the player on a display of said gaming device one or more of said photos;

providing means for the player to select one or more of the presented photos; and responsive to selection of the one or more photos, utilizing said selected photos as game indicia on said gaming device during play of a subject game thereon.

8. The method of claim 7 further comprising moving said photos to a server in direct communication with said plurality of gaming devices.

9. The method of claim 7 further comprising identifying said player using a player club card, FOB device, RFID device, biometric device and/or PIN.

* * * * *